US011470887B2

(12) United States Patent
Csaszar

(10) Patent No.: US 11,470,887 B2
(45) Date of Patent: Oct. 18, 2022

(54) COLLAR SUPPORT APPARATUS

(71) Applicant: Norbert Csaszar, Austin, TX (US)

(72) Inventor: Norbert Csaszar, Austin, TX (US)

( * ) Notice: Subject to any disclaimer, the term of this patent is extended or adjusted under 35 U.S.C. 154(b) by 77 days.

(21) Appl. No.: 17/060,777

(22) Filed: Oct. 1, 2020

(65) Prior Publication Data

US 2022/0104555 A1 Apr. 7, 2022

(51) Int. Cl.
*A41B 3/06* (2006.01)

(52) U.S. Cl.
CPC ..... *A41B 3/06* (2013.01)

(58) Field of Classification Search
CPC .... A41B 3/06; A41B 3/08; A41B 3/12; A41B 3/18; A41B 5/00; A41B 1/14; A41B 1/20; A41B 7/08; A41B 7/12; A41D 27/16; A41D 27/14; A41D 27/145; A41D 27/06; A41D 25/16; A41D 25/006; D06F 89/026; A42B 1/0183; A42B 1/002
USPC ..... 2/255, 262, 263, 175.4, 175.5, 181, 2/181.4, 182.2; 223/27, 81, 82, 83
See application file for complete search history.

(56) References Cited

U.S. PATENT DOCUMENTS 1,497,254 A * 6/1924 Winnett ..... A41B 3/06 2/129
1,543,604 A * 6/1925 Fish ..... A41B 3/06 2/129
1,798,803 A 3/1931 Ormsbee
1,995,021 A 3/1935 Beghetti
2,110,525 A * 3/1938 Ernst ..... A41B 3/06 2/132
2,275,098 A * 3/1942 Welch ..... B65D 85/182 223/83
2,483,952 A * 10/1949 Wayworth ..... A41D 27/145 2/232
2,487,284 A * 11/1949 Thomas ..... A41B 3/06 2/132
2,639,436 A 5/1953 Gavrilovich
2,668,295 A 2/1954 Garrido
3,046,562 A * 7/1962 Bellanti ..... A41B 3/06 2/134
4,922,553 A * 5/1990 Morrone ..... A41D 27/08 2/129
9,717,280 B2 8/2017 Truong
2006/0230500 A1* 10/2006 Chelelat ..... A41C 1/14 2/255
2007/0277293 A1* 12/2007 Koepp ..... A41B 3/06 2/256
2010/0313331 A1 12/2010 English
2014/0090152 A1* 4/2014 Fernandez ..... A41B 3/06 2/256
2016/0278437 A1* 9/2016 Spitzfaden ..... A41B 3/06
2017/0020202 A1* 1/2017 Truong ..... A41B 3/06

* cited by examiner

*Primary Examiner* — Amy Vanatta

(57) ABSTRACT

A collar support apparatus for maintaining a soft collar in position includes a collar body having a body first half, a body second half, a body front side, and a body back side. The body first half is hingingly coupled to the body second half along a midline of the collar body. The collar body is configured to fit within a shirt collar. An adhesive strip is coupled to the collar body to secure the collar body to the shirt collar. A plurality of reinforcement strips is coupled within the collar body and is sufficiently flexible to allow the collar body to fold along the midline and maintain a shape with the body first half and the body second half forming a desired angle.

7 Claims, 5 Drawing Sheets

COLLAR SUPPORT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to collar stay devices and more particularly pertains to a new collar stay device for maintaining a soft collar in position.

(2) Description of Related Art Including Information Disclosed Under 37 CFR 1.97 and 1.98

The prior art relates to collar stay devices. Most known devices only operate on one side of the collar. Those devices which do fold to operate on both sides of the collar are a simple rectangular shape. These devices do not have an hourglass shape or a plurality of parallel support strips.

BRIEF SUMMARY OF THE INVENTION

An embodiment of the disclosure meets the needs presented above by generally comprising a collar body having a body first half, a body second half, a body front side, and a body back side. The body first half is hingingly coupled to the body second half along a midline of the collar body. The collar body is configured to fit within a shirt collar with the body first half fitting within a proximal portion of the shirt collar extending from a shirt body. The midline is positioned along a collar crease of the shirt collar and the body second half fits within a folded portion of the shirt collar. An adhesive strip is coupled to the collar body. The adhesive strip is coupled to the body back side and extends from the body first half to the body second half. The adhesive strip is configured to secure the collar body to the shirt collar. A plurality of reinforcement strips is coupled to the collar body. The plurality of reinforcement strips is coupled within the collar body and extends from the body first half to the body second half. Each reinforcement strip is sufficiently flexible to allow the collar body to fold along the midline and maintain a shape with the body first half and the body second half forming a desired angle between 0° and 60°.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
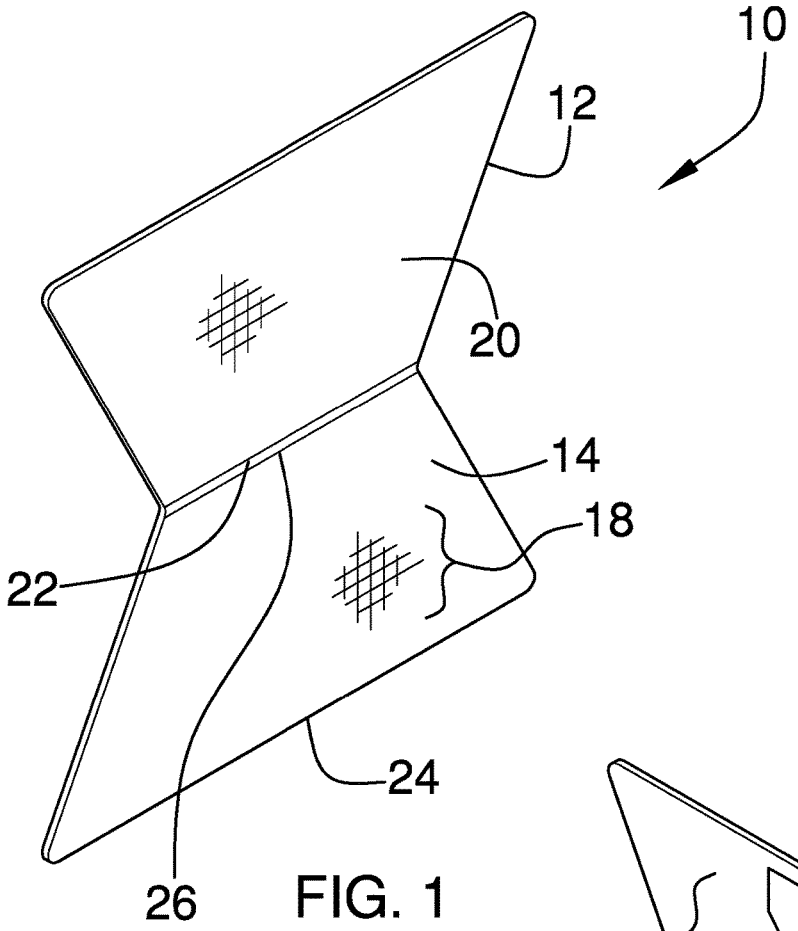
FIG. 1 is an isometric view of a collar support apparatus according to an embodiment of the disclosure.
Figure 2:
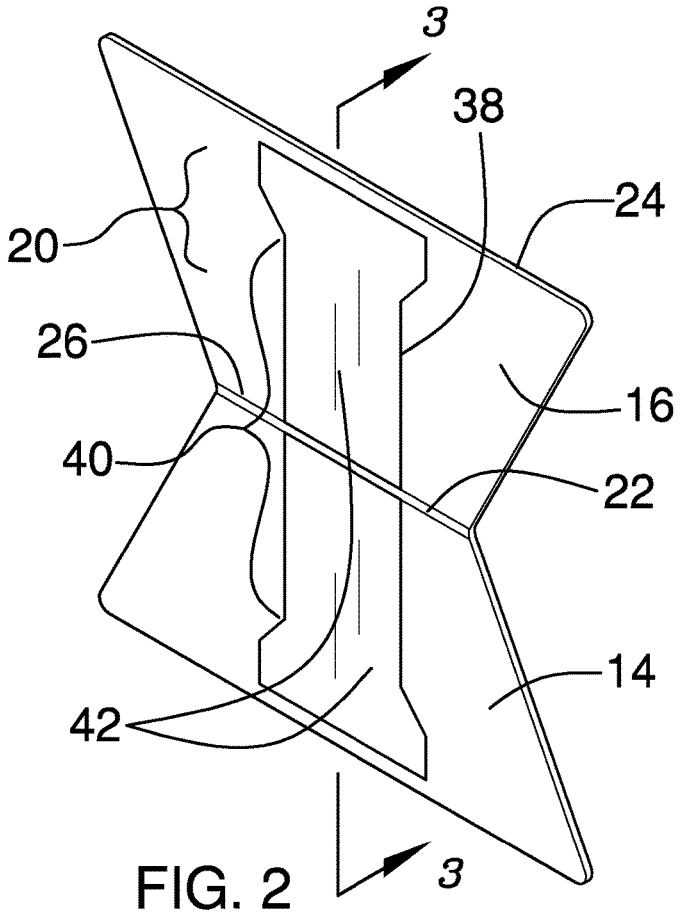
FIG. 2 is an isometric view of an embodiment of the disclosure.
Figure 3:
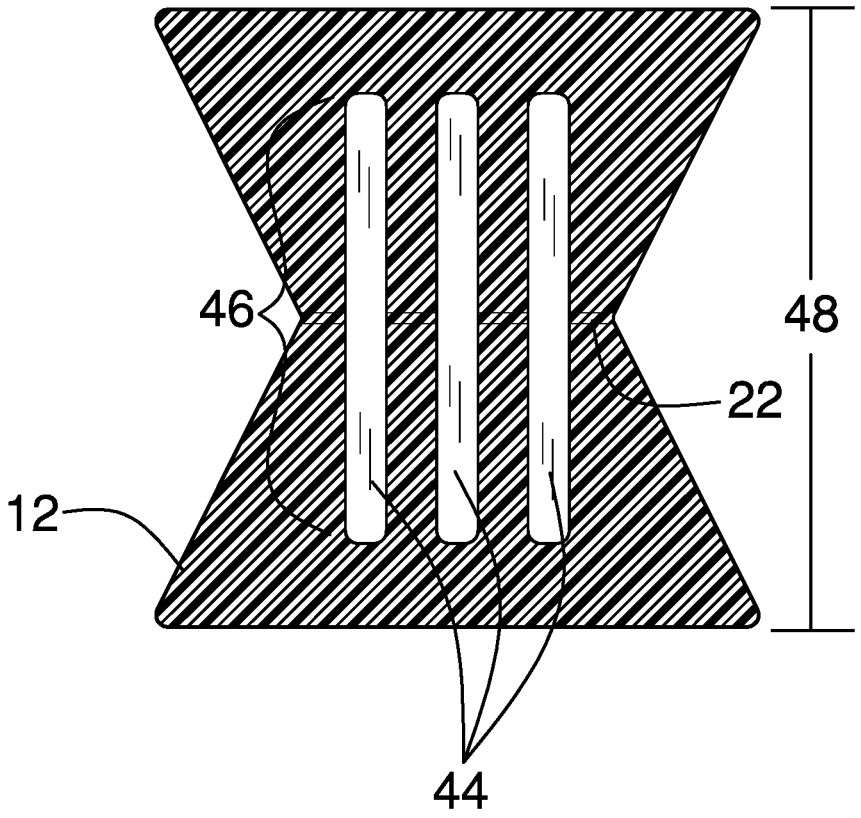
FIG. 3 is a cross-sectional view of an embodiment of the disclosure along the line 3-3 of FIG. 2.
Figure 4:
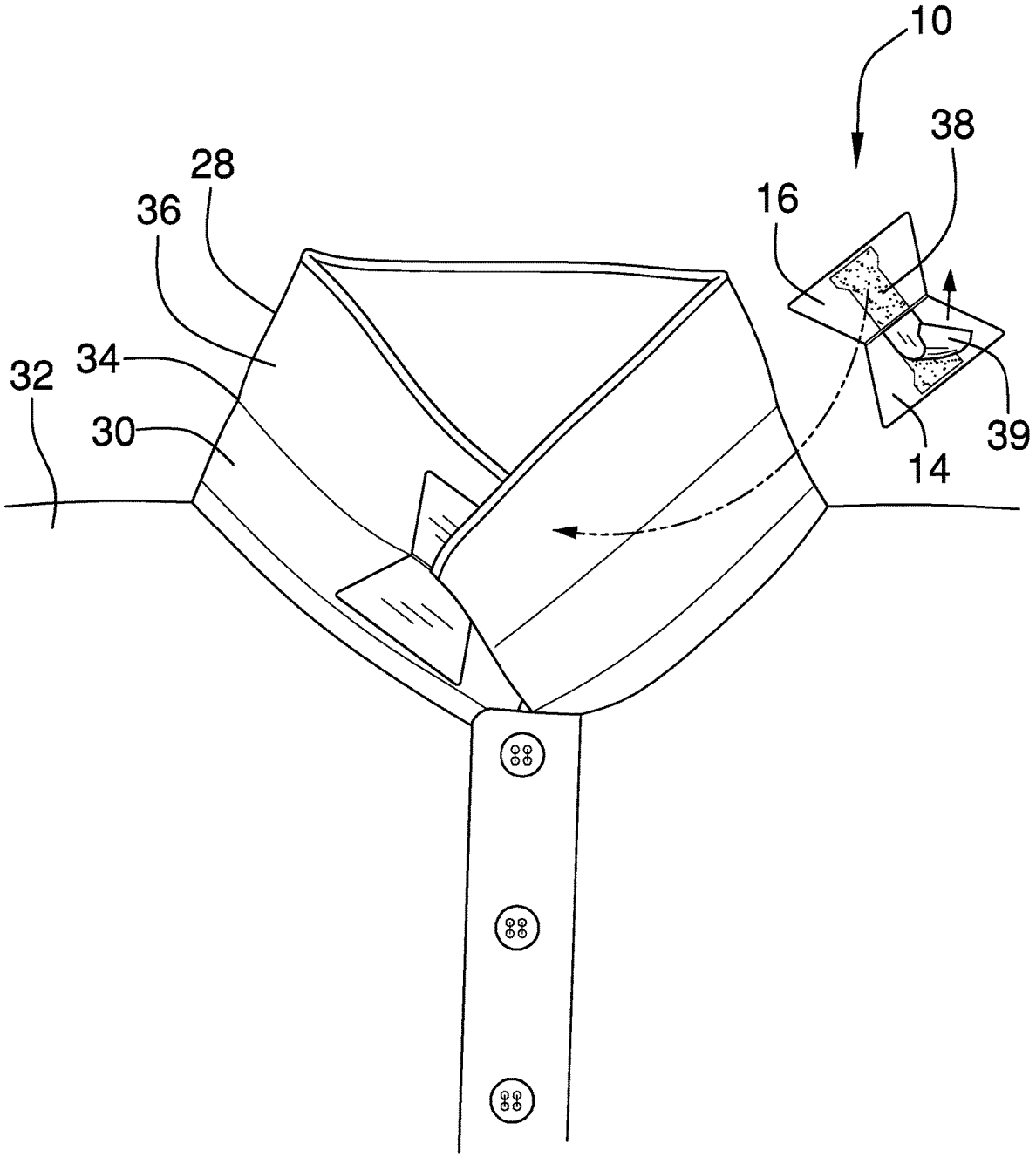
FIG. 4 is an in-use view of an embodiment of the disclosure.
Figure 5:
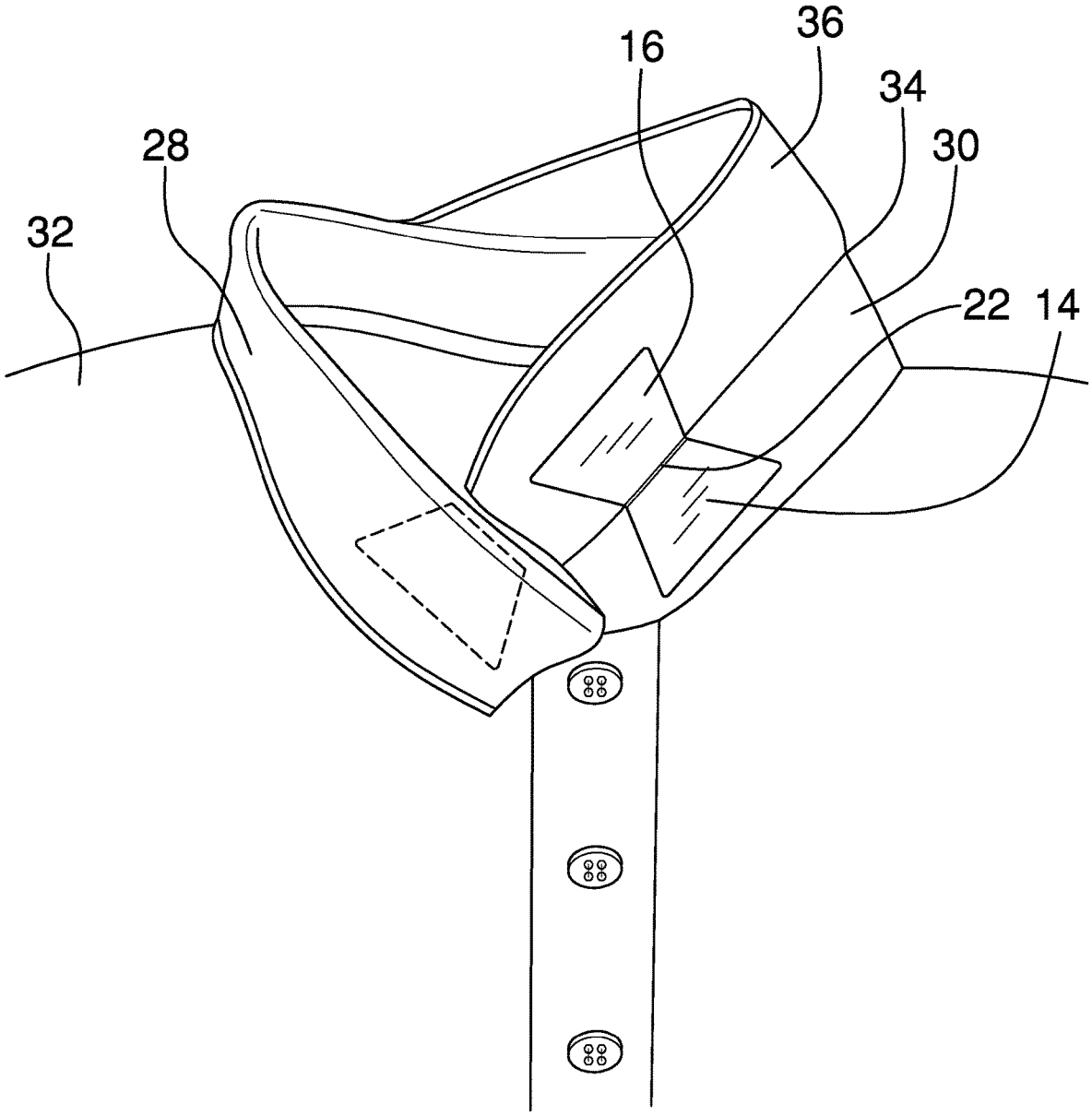
FIG. 5 is an in-use view of an embodiment of the disclosure.
Figure 6:
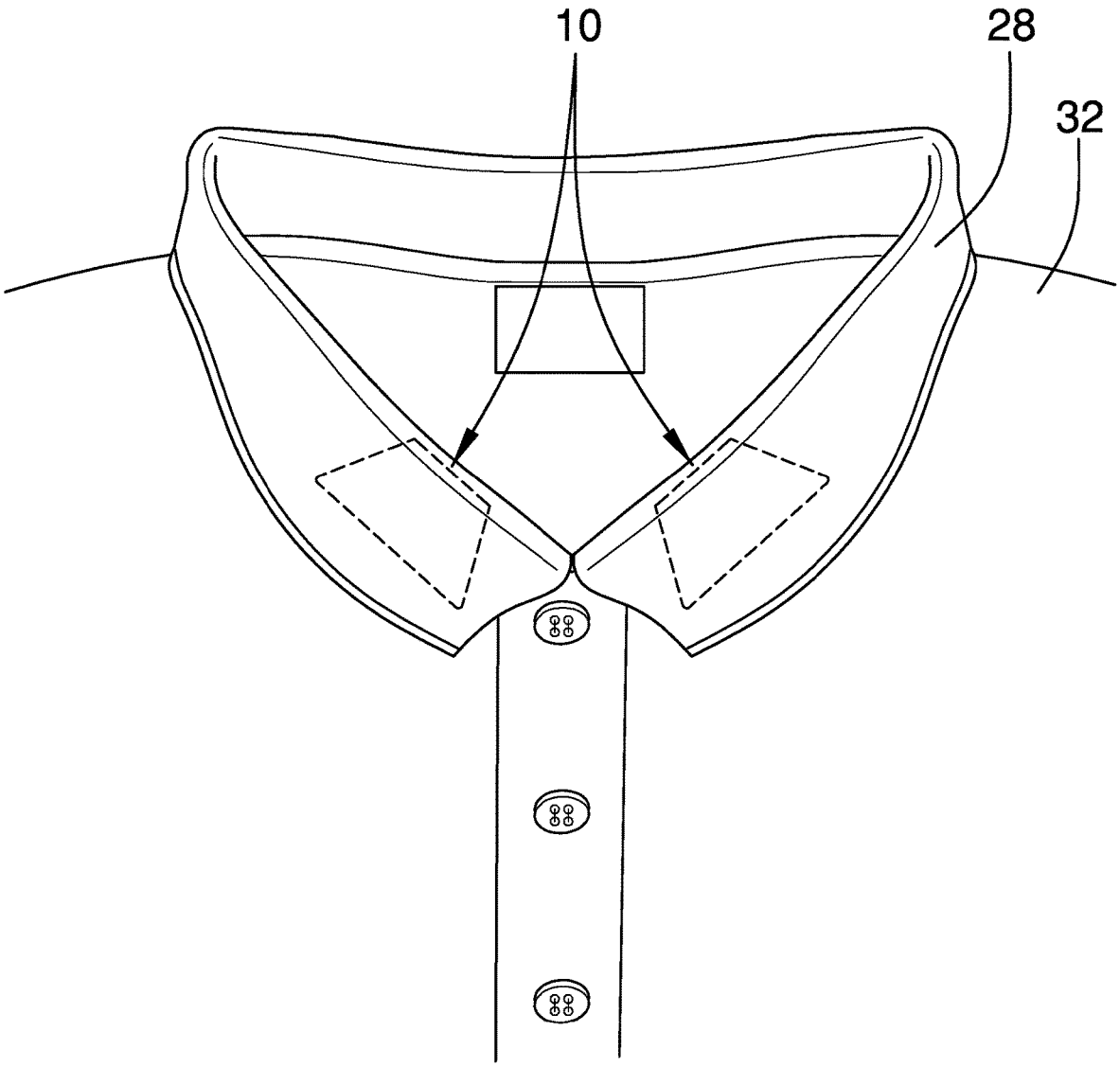
FIG. 6 is an in-use view of an embodiment of the disclosure.

With reference now to the drawings, and in particular to FIGS. 1 through 6 thereof, a new collar stay device embodying the principles and concepts of an embodiment of the disclosure and generally designated by the reference numeral 10 will be described.

As best illustrated in FIGS. 1 through 6, the collar support apparatus 10 generally comprises a collar body 12 having a body first half 14, a body second half 16, a body front side 18, and a body back side 20. The body first half 14 is hingingly coupled to the body second half 16 along a midline 22 of the collar body. Each of the body first half 14 and the body second half 16 may be trapezoidal and each has a long edge 24 and a short edge 26. The short edge 26 of each of the body first half 14 and the body second half 16 is joined at the midline 22.

The collar body 12 is configured to fit within a shirt collar 28 with the body first half 14 fitting within a proximal portion 30 of the shirt collar extending from a shirt body 32. The midline 22 is positioned along a collar crease 34 of the shirt collar and the body second half 16 fits within a folded portion 36 of the shirt collar. The collar body 12 may have rounded corners to prevent catching on the shirt collar 28 and to limit external visibility while in use.

An adhesive strip 38 is coupled to the collar body 12. The adhesive strip 38 is coupled to the body back side 20 and extends from the body first half 14 to the body second half 16. The adhesive strip 38 is configured to secure the collar body 12 to the shirt collar 28 by adhering to the proximal portion 30 and the folded portion 36. The adhesive strip 38 may have a removable cover 39 to prevent inadvertent adhesion before being applied to the shirt collar 28. The adhesive strip 38 may have a rectangular portion 40 oriented perpendicularly to the midline 22 and a pair of flared end portions 42 to ensure strong adhesion proximal the long edge 24 of each of the body first half 14 and the body second half 16.

A plurality of reinforcement strips 44 is coupled to the collar body 12. The plurality of reinforcement strips 44 is coupled within the collar body 12 and extends from the body first half 14 to the body second half 16. The plurality of reinforcement strips 44 may be arranged in parallel and perpendicular to the midline 22. The plurality of reinforcement strips 44 may be three reinforcement strips. A strip length 46 of each of the plurality of reinforcement strips 44 may be equal to at least 50% of a body length 48 of the collar body to ensure structural reinforcement and prevent the collar body 12 from bending. Each reinforcement strip 44 is sufficiently flexible to allow the collar body 12 to fold along the midline 22 and maintain a shape with the body first half 14 and the body second half 16 forming a desired angle between 0° and 60°.

In use, the removable cover 39 is peeled back to expose the adhesive strip 38 and the collar body 12 is attached to the shirt collar 28. The folded portion 36 of the shirt collar is then pressed down, bending the collar body 12 along the midline 22 until the shirt collar 28 takes the desired position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collar support apparatus comprising:

a collar body having a body first half, a body second half, a body front side, and a body back side, the body first half being hingingly coupled to the body second half along a midline of the collar body, the collar body being configured to fit within a shirt collar with the body first half fitting within a proximal portion of the shirt collar extending from a shirt body, the midline positioned along a collar crease of the shirt collar, and the body second half fitting within a folded portion of the shirt collar, each of the body first half and the body second half being trapezoidal and each having a long edge and a short edge, the short edge of each of the body first half and the body second half being joined at the midline wherein each long edge is positioned distally relative to the midline wherein the long edges are configured for positioning spaced from the collar crease;

an adhesive strip coupled to the collar body, the adhesive strip being coupled to the body back side and extending from the body first half to the body second half, the adhesive strip being configured to secure the collar body to the shirt collar; and a plurality of reinforcement strips coupled to the collar body, the plurality of reinforcement strips being coupled within the collar body and extending from the body first half to the body second half, each reinforcement strip being sufficiently flexible to allow the collar body to fold along the midline and maintain a shape with the body first half and the body second half forming a desired angle between 0° and 60°.

2. The collar support apparatus of claim 1 further comprising the plurality of reinforcement strips being arranged in parallel.

3. The collar support apparatus of claim 2 further comprising the plurality of reinforcement strips being arranged perpendicular to the midline.

4. The collar support apparatus of claim 3 further comprising the plurality of reinforcement strips being three reinforcement strips.

5. The collar support apparatus of claim 1 further comprising a strip length of each of the plurality of reinforcement strips being equal to at least 50% of a body length of the collar body.

6. The collar support apparatus of claim 1 further comprising the collar body having rounded corners.

7. A collar support apparatus comprising:

a collar body having a body first half, a body second half, a body front side, and a body back side, the body first half being hingingly coupled to the body second half along a midline of the collar body, each of the body first half and the body second half being trapezoidal and each having a long edge and a short edge, the short edge of each of the body first half and the body second half being joined at the midline wherein each long edge is positioned distally relative to the midline wherein the long edges are configured for positioning spaced from a collar crease of a shirt collar, the collar body being configured to fit within the shirt collar with the body first half fitting within a proximal portion of the shirt collar extending from a shirt body, the midline positioned along the collar crease of the shirt collar, and the body second half fitting within a folded portion of the shirt collar, the collar body having rounded corners;

an adhesive strip coupled to the collar body, the adhesive strip being coupled to the body back side and extending from the body first half to the body second half, the adhesive strip being configured to secure the collar body to the shirt collar; and a plurality of reinforcement strips coupled to the collar body, the plurality of reinforcement strips being coupled within the collar body and extending from the body first half to the body second half, the plurality of reinforcement strips being arranged in parallel and perpendicular to the midline, the plurality of reinforcement strips being three reinforcement strips, a strip length of each of the plurality of reinforcement strips being equal to at least 50% of a body length of the collar body, each reinforcement strip being sufficiently flexible to allow the collar body to fold along the midline and maintain a shape with the body first half and the body second half forming a desired angle between 0° and 60°.

* * * * *